US008664894B2

(12) United States Patent
Zwerver

(10) Patent No.: US 8,664,894 B2
(45) Date of Patent: Mar. 4, 2014

(54) METHOD AND DEVICE FOR DRIVING A FLUORESCENT LAMP

(75) Inventor: Hendrik Jan Zwerver, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 69 days.

(21) Appl. No.: 13/514,181

(22) PCT Filed: Nov. 23, 2010

(86) PCT No.: PCT/IB2010/055358

§ 371 (c)(1),
(2), (4) Date: Jun. 6, 2012

(87) PCT Pub. No.: WO2011/070470

PCT Pub. Date: Jun. 16, 2011

(65) Prior Publication Data

US 2012/0242253 A1 Sep. 27, 2012

(30) Foreign Application Priority Data

Dec. 8, 2009 (EP) ..... 09178399

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H01J 13/48*** | (2006.01) |
| ***H01J 17/36*** | (2006.01) |
| ***H05B 37/00*** | (2006.01) |
| ***H05B 39/00*** | (2006.01) |
| ***H05B 41/00*** | (2006.01) |
| *H05B 41/16* | (2006.01) |
| *H05B 41/24* | (2006.01) |

(52) U.S. Cl.

USPC ..... 315/307; 315/209 R; 315/246; 315/326

(58) Field of Classification Search

None

See application file for complete search history.

(56) References Cited

U.S. PATENT DOCUMENTS 4,928,038 A 5/1990 Nerone
5,066,894 A 11/1991 Klier (Continued)

FOREIGN PATENT DOCUMENTS

DE 102005018774 A1 10/2006
DE 102006011970 A1 9/2007

(Continued)

OTHER PUBLICATIONS

Chan, Samuel S.M. et al "A Lamp Power Control Scheme for Dimmable Electronic Ballasts to Minimize the Temperature Effect on the Lamp Brightness", IEEE Power Electronics Letters, vol. 3, No. 1, Mar. 2005, pp. 34-39.

*Primary Examiner* — Douglas W Owens
*Assistant Examiner* — Dedei K Hammond

(57) ABSTRACT

A method is described for driving a fluorescent lamp (L) with variable light output within a dimming range between a low dimming level and a high dimming level. The lamp power and the lamp current are monitored. At high dimming level the lamp control is based on current control; at low dimming level, the lamp control is based on power control; at intermediary levels the lamp control is based on both current and power control. A first measuring signal (Ilamp) indicating lamp current and a second measuring signal (Plamp) indicating lamp power are obtained. An error signal (Serr) is calculated as a function of the said two measuring signals and as a function of dim level. With increasing dim level, the contribution of the first measuring signal (Ilamp) to the error signal (Serr) increases while the contribution of the second measuring signal (Plamp) to the error signal (Serr) decreases.

6 Claims, 4 Drawing Sheets

(56) References Cited

U.S. PATENT DOCUMENTS

| | | | |
|---|---|---|---|
| 5,198,726 | A | 3/1993 | Van Meurs |
| 5,262,701 | A | 11/1993 | Derra |

FOREIGN PATENT DOCUMENTS

| | | | |
|---|---|---|---|
| EP | 0422255 | A1 | 4/1991 |
| EP | 0461441 | A1 | 12/1991 |
| EP | 1395096 | A2 | 3/2004 |
| JP | 2003133098 | A | 5/2003 |

METHOD AND DEVICE FOR DRIVING A FLUORESCENT LAMP

FIELD OF THE INVENTION

The present invention relates in general to a method and device for driving a fluorescent lamp. Specifically, the present invention relates to such driver with dimming capabilities.

BACKGROUND OF THE INVENTION

Fluorescent lamps, and devices for driving them, are commonly known, therefore a detailed explanation is omitted here. FIG. 1 is a schematic block diagram, showing a fluorescent lamp L and a driver 1 for driving this lamp. The driver has an input terminal 2 for receiving a user input command signal indicating a desired dim level in a range between 0 and 100%. If the input command signal indicates a dim level of 100%, the lamp L is operated at 100% of its nominal rating to produce 100% of its nominal light output. If the input command signal indicates a lower dim level, the lamp L is operated with reduced power to produce a reduced light output. The input command signal may for instance be an analog signal or a digital signal, for instance according to the DALI specification, in which case the desired output level as function of the DALI signal is precisely specified. In any case, it is required that the light output is stable, and in the case of a DALI system the light output should meet the DALI specifications.

One solution would be to actually measure the light output, but this is complicated and relatively expensive as it requires the addition of at least one optical sensor. Therefore, in practical systems, the light output is monitored and controlled by monitoring and controlling an electrical parameter, based on the knowledge that the light output is proportional to such electrical parameter.

One electrical parameter that is suitable as control parameter is lamp current; lamp drivers where the lamp current is used as control parameter are known.

Another electrical parameter that is suitable as control parameter is lamp power; lamp drivers where the lamp power is used as control parameter are known.

SUMMARY OF THE INVENTION

When a lamp is operated at or close to 100% of its nominal light output, the use of current control is preferred over power control with a view to, among other things, lamp life. On the other hand, when a lamp is dimmed to low dim percentages, the use of power control is preferred over current control with a view to color stability.

There are also lamp drivers capable of switching between current control and power control. An example is disclosed in U.S. Pat. No. 5,066,894. This document discloses another control mechanism based on measuring discharge resistance in cases where current control and power control are both inadequate. However, whenever the point is reached where a switch is made from one control method to the other, there is the risk of a discontinuity in lamp behavior leading to light flicker.

The present invention aims to overcome the above disadvantages. Particularly, the present invention aims to provide a device for driving a fluorescent lamp over a large dimming range, which device enjoys the advantages of power control in the low dimming range as well as the advantages of current control in the high dimming range and that does not suffer the disadvantages of switching between different control schemes.

According to an important aspect of the present invention, a lamp is controlled using current control in combination with power control, wherein the ratio of the current influence and the power influence in the control is continuously changed as a function of dimming level.

Further advantageous elaborations are mentioned in the dependent claims.

It is noted that dimming will reduce the light output, so that more dimming will result in less light. In context of the present invention, the wording "dimming level" will be used in a meaning corresponding to "dimmed light level", so dimming level zero corresponds to no light output.

BRIEF DESCRIPTION OF THE DRAWINGS

These and other aspects, features and advantages of the present invention will be further explained by the following description of one or more preferred embodiments with reference to the drawings, in which same reference numerals indicate same or similar parts, and in which.

DETAILED DESCRIPTION OF THE INVENTION

Figure 1:
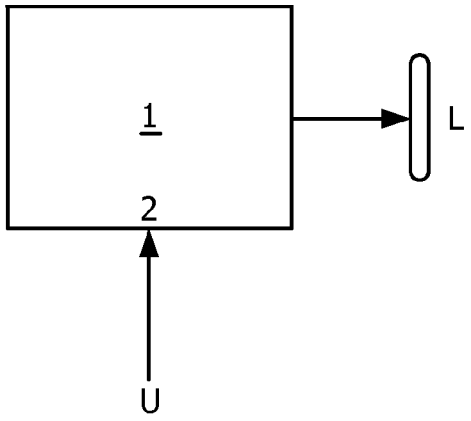
FIG. 1 is a block diagram schematically showing a driver for driving a fluorescent lamp.
Figure 2:
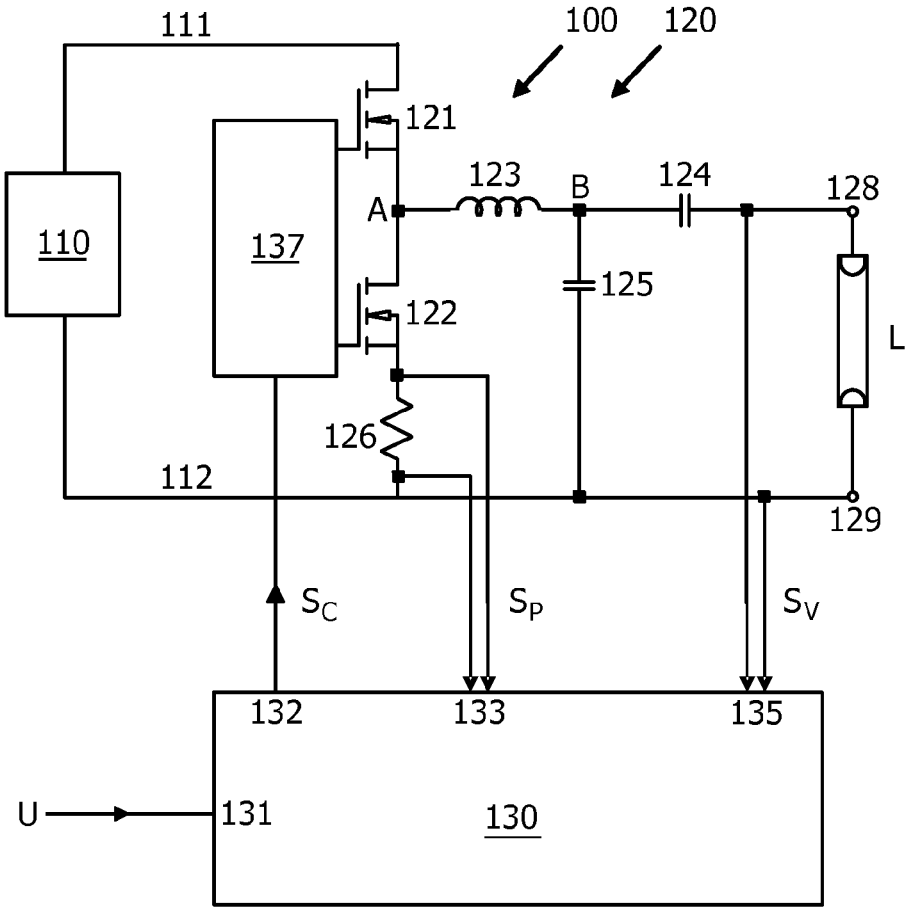
FIG. 2 is a block diagram schematically showing a driver according to the present invention.

FIG. 2 schematically shows an embodiment of a lamp driver according to the present invention, generally indicated by reference numeral 100. The driver 100 comprises a supply stage 110 for providing a substantially constant voltage at supply lines 111, 112, the supply stage 100 for instance converting mains AC voltage to lamp voltage. Since suitable supply stages are known, a more detailed description and explanation is omitted.

The driver 100 further comprises a switching stage 120 having output terminals 128, 129 for connection to the lamp electrodes of lamp L, the switching stage 120 having a half-bridge topology in this example. Particularly, the switching stage 120 comprises a series arrangement of two controllable switches 121, 122 connected between the two supply lines 111, 112; the node between said two switches is indicated A. A series arrangement of an inductor 123 and a first capacitor 124 is connected between the node A and one output terminal 128, while the other output terminal 129 is connected directly to the second supply line 112. A second capacitor 125 is connected between said second supply line 112 and the node B between said inductor 123 and first capacitor 124. The controllable switches 121, 122 are suitably implemented as NMOSFETS.

For controlling the two controllable switches 121, 122, the driver 100 comprises a control device 130, for instance implemented as a suitably programmed microprocessor, having a control output 132 for generating control signals Sc to the two controllable switches 121, 122 via a level shifter 137. It is noted that the level shifter 137 and the control device 130 may be integrated as one single device. It is further noted that the precise nature of the control signals is not relevant and does not have to be explained to a person skilled in the art; the only important aspect is that variation of the control signals allows variation of the lamp current between zero and 100%, typically duty cycle control.

The control device 130 has a command input 131 for receiving user input command signals, for instance DALI signals, indicating a desired output light level or dim level. The control device 130 further has a current input 134 for receiving a measuring signal Sp indicating the output power provided to the lamp, and a voltage input 135 for receiving a measuring signal Sv indicating the lamp voltage. For providing a measuring signal Sp indicating the output power provided to the lamp, the driver 100 comprises a resistance 126 arranged in series with the switches 121, 122, the measuring signal Sp being taken as the voltage drop over the resistance 126, which would be proportional to the current in the switches and thus proportional to the power. For providing a measuring signal Sv indicating the lamp voltage, the driver 100 may comprise a separate voltage sensor or such sensor may be integrated in the control device 130, as shown, in which case the voltage input 135 is connected to the lamp output terminals 128, 129. The control device 130 is capable of calculating the (average) lamp current by dividing the (average) lamp power by the (average) lamp voltage.

It is noted that, alternatively, it could be possible to measure the lamp current directly, but this would need a measuring resistor in series with the lamp and would be difficult at low dim levels. In any case, it is noted that measuring lamp voltage and/or lamp current and/or lamp power is known per se.

Figure 3A:
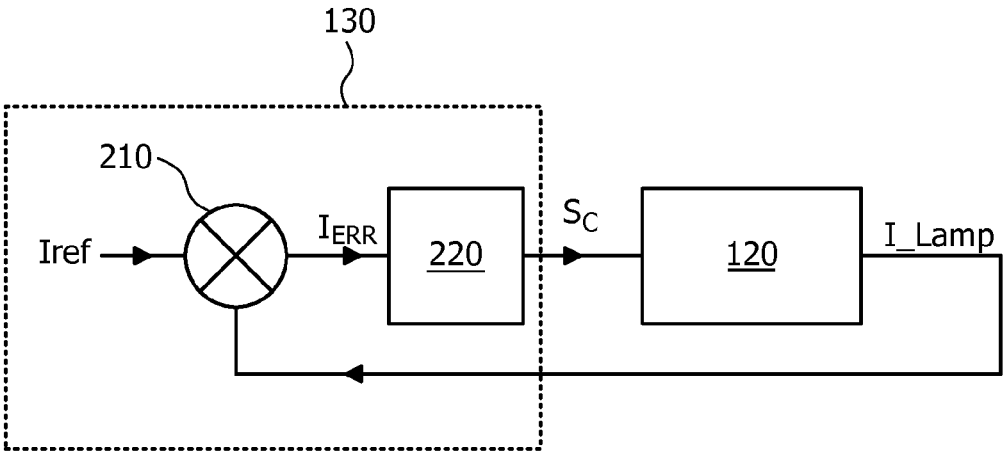
FIG. 3A schematically illustrates current control.

FIG. 3A is a block diagram schematically illustrating the operation of a control device according to prior art, comprising a current feedback loop for implementing current control. For sake of ease, the reference numerals of FIG. 2 are used. The current control device 130 comprises an adder/subtracter 210 and a control signal generator 220 having an input coupled to the output of the adder/subtracter 210. At one input, the adder/subtracter 210 receives a current reference signal Iref which may be equal to or derived from the user control input signal, and at another input the adder/subtracter 210 receives a signal Ilamp representing the (average) lamp current. The adder/subtracter 210 subtracts the current signal Ilamp from the reference signal Iref. The output signal from the adder/subtracter 210 can be seen as an error signal, and is indicated Ierr. The control signal generator 220 receives this error signal, and adapts its output control signals Sc such that the error signal Ierr is reduced.

Figure 3B:
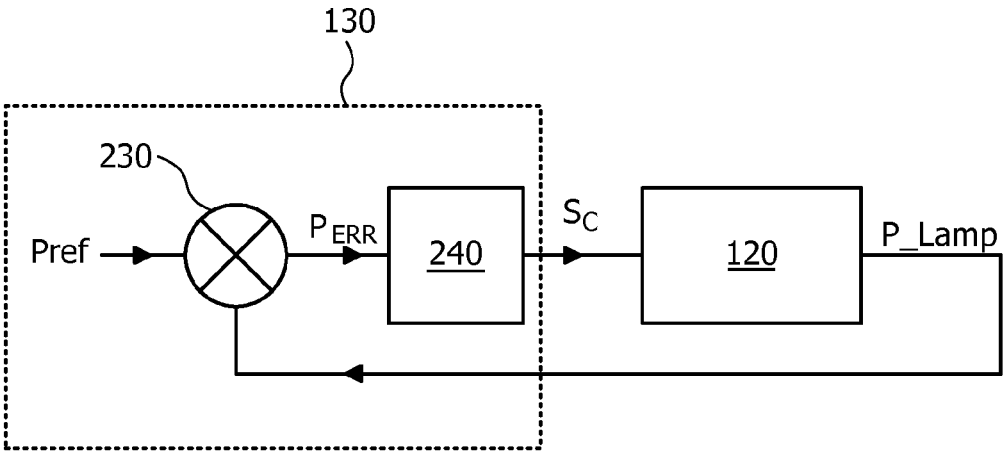
FIG. 3B schematically illustrates power control.

FIG. 3B is a block diagram schematically illustrating the operation of a control device according to prior art, comprising a power feedback loop for implementing power control. For sake of ease, the reference numerals of FIG. 2 are used. The current control device 130 comprises an adder/subtracter 230 and a control signal generator 240 having an input coupled to the output of the adder/subtracter 230. At one input, the adder/subtracter 230 receives a power reference signal Pref which may be equal to or derived from the user control input signal, and at another input the adder/subtracter 230 receives a signal Plamp representing the (average) lamp power. The adder/subtracter 230 subtracts the power signal Plamp from the reference signal Pref. The output signal from the adder/subtracter 230 can be seen as an error signal, and is indicated Perr. The control signal generator 240 receives this error signal, and adapts its output control signals Sc such that the error signal Perr is reduced.

Figure 4:
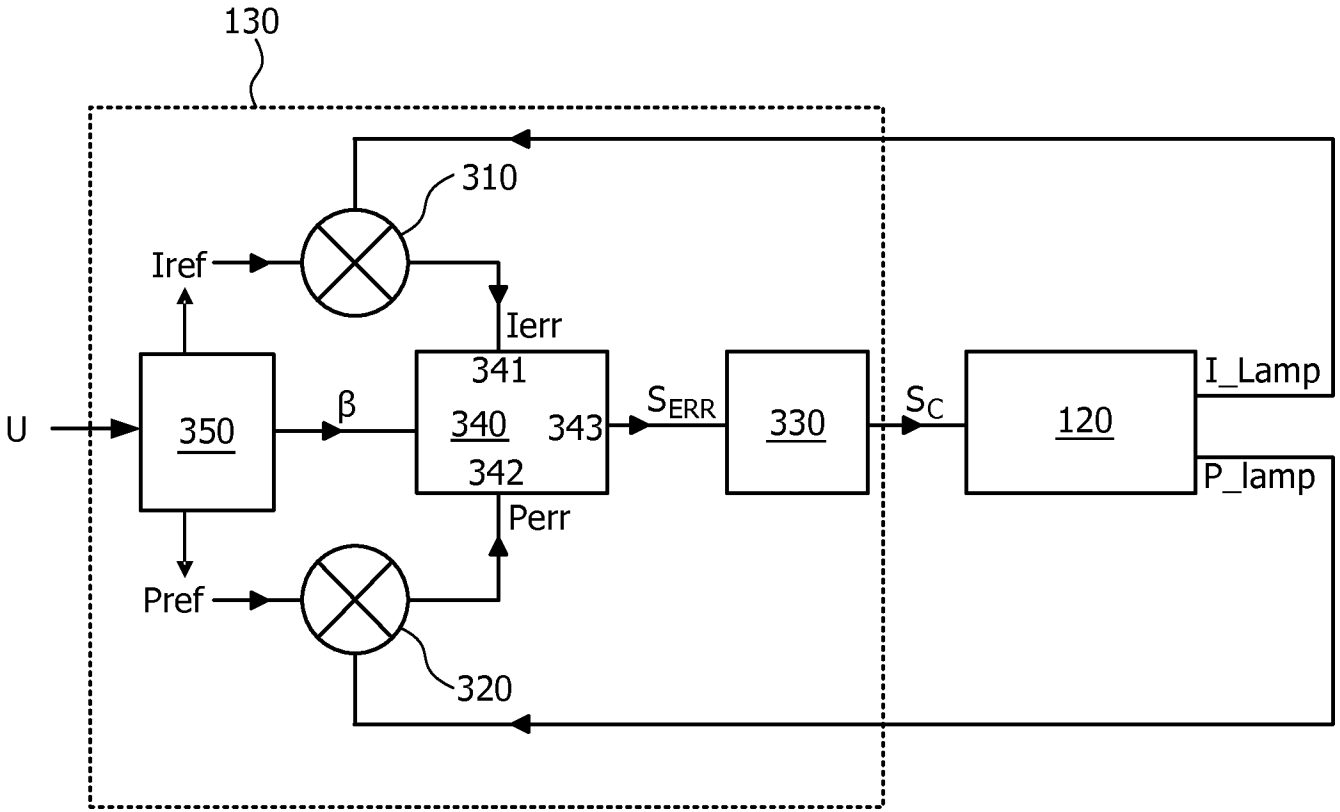
FIG. 4 schematically illustrates mixed current and power control according to the present invention.

FIG. 4 is a block diagram comparable to FIGS. 3A and 3B, schematically illustrating the operation of a control device according to the present invention, comprising both a current feedback loop and a power feedback loop such as to implement mixed current and power control. The current control device 130 comprises a first adder/subtracter 310 and a second adder/subtracter 320. At one input, the first adder/subtracter 310 receives a current reference signal Iref which is derived from the user control input signal, and at another input the first adder/subtracter 310 receives a signal Ilamp representing the (average) lamp current. The first adder/subtracter 310 subtracts the current signal Ilamp from the reference signal Iref. The output signal from the first adder/subtracter 310 can be seen as an error signal, and is indicated Ierr. Likewise, the second adder/subtracter 320 receives a power reference signal Pref which is derived from the user control input signal, and receives a signal Plamp representing the (average) lamp power. The second adder/subtracter 320 subtracts the power signal Plamp from the reference signal Pref. The output signal from the second adder/subtracter 320 can be seen as an error signal, and is indicated Perr.

The current control device 130 further comprises a control signal generator 330, having an input receiving a combined error signal Serr, and adapting its output control signals Sc such that the combined error signal Serr is reduced (in normal operation, the combined error signal Serr will be zero).

The current control device 130 further comprises an error mixer 340, having a first input 341 receiving the current error signal Ierr, having a second input 342 receiving the power error signal Perr, and having an output 343 providing the combined error signal Serr to the control signal generator 330.

The current control device 130 further comprises a user control input signal converter 350, receiving the user control input signal and, on the basis of the user control input signal received, generating the current reference signal Iref, the power reference signal Pref, and a control signal for the error mixer 340. Conveniently, the control input signal converter 350 may be implemented as a look-up table, or a calculator, having a one-to-one relationship between input control signal and output signals. Illustratively, the control signal for the error mixer 340 may be a factor β in the range from 0 to 1, corresponding to dim level. In the case of a DALI system, the control input signal converter 350 may calculate the output signals according to the following formulas:

$$\beta = 0.01 \times 10^{\frac{3(D-1)}{253}-1},$$

wherein D indicates the DALI steps

Pref=β·Pmax, wherein Pmax indicates the maximum power

Iref=β·Imax, wherein Imax indicates the maximum current

It is noted that D is an integer ranging between 1 and 254, so that β can range from 0.001 to 1.

The error mixer 340 calculates the combined error signal Serr as a function of the current error signal Ierr, the power error signal Perr, and the control signal β, which may be expressed in a formula as Serr=f(Ierr, Perr, β).

There are several possibilities for such function. In any case, the function f should be such that with increasing β the contribution from Ierr is increasing (or constant) while the contribution from Perr is decreasing (or constant). Preferably, the function f can be written as an addition of two separate functions f1 and f2 for Ierr and Perr, respectively:

$$f(\text{Ierr},\text{Perr},\beta)=f1(\text{Ierr},\beta)+f2(\text{Perr},\beta)$$

In a suitable and simple embodiment, these two functions are linear functions:

$$f1(\text{Ierr},\beta)=\beta\cdot\text{Ierr};\ f2(\text{Perr},\beta)=(1-\beta)\cdot\text{Perr}$$

Figure 5:
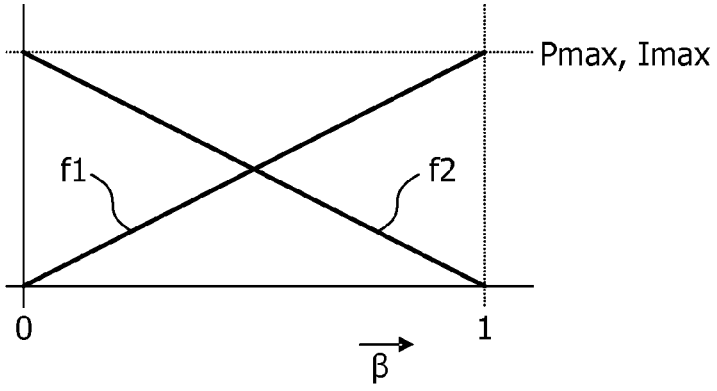
FIG. 5 is a graph schematically illustrating two error functions for current and power, respectively.

FIG. 5 is a graph illustrating these two functions, wherein the horizontal axis represents β and wherein the vertical axis represents f1 and f2.

Figure 6A:
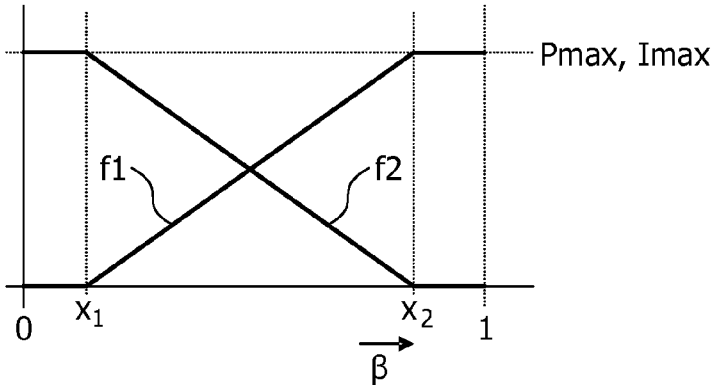
FIGS. 6A and 6B are graphs schematically illustrating variations of the error functions.

In the embodiment discussed above, f1 and f2 are functions that increase/decrease linearly in the range from 0 to 1. This is, however, not necessary. FIG. 6A shows a variation, where f1=0 in the range 0<β<x1, where f1=1 in the range x2<β<1, and where f1 increases linearly in the range x1<β<x2, while f2 decreases linearly in the same range. It may also be that f1 and f2 vary over mutually different ranges.

Figure 6B:
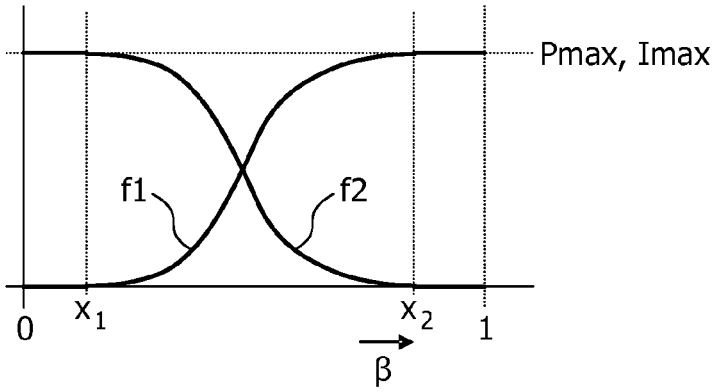

FIG. 6B shows a variation where f1 increases continuously within a certain range with an S-curve of which the derivative δf/δβ is close to or equal to zero close to the edges of the margin, while the same applies to f2. Such shape may for instance be a sine-shape.

Summarizing, a method is described for driving a fluorescent lamp (L) with variable light output within a dimming range between a low dimming level and a high dimming level. The lamp power and the lamp current are monitored. At high dimming level, the lamp control is based on current control; at low dimming level, the lamp control is based on power control; at intermediary levels the lamp control is based on both current and power control.

A first measuring signal (Ilamp) indicating lamp current and a second measuring signal (Plamp) indicating lamp power are obtained. An error signal (Serr) is calculated as a function of the said two measuring signals and as a function of dim level. With increasing dim level, the contribution of the first measuring signal (Ilamp) to the error signal (Serr) increases while the contribution of the second measuring signal (Plamp) to the error signal (Serr) decreases.

While the invention has been illustrated and described in detail in the drawings and foregoing description, it should be clear to a person skilled in the art that such illustration and description are to be considered illustrative or exemplary and not restrictive. The invention is not limited to the disclosed embodiments; rather, several variations and modifications are possible within the protective scope of the invention as defined in the appending claims.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

In the above, the present invention has been explained with reference to block diagrams, which illustrate functional blocks of the device according to the present invention. It is to be understood that one or more of these functional blocks may be implemented in hardware, where the function of such functional block is performed by individual hardware components, but it is also possible that one or more of these functional blocks are implemented in software, so that the function of such functional block is performed by one or more program lines of a computer program or a programmable device such as a microprocessor, microcontroller, digital signal processor, etc.

The invention claimed is:

1. Method for driving a fluorescent lamp (L) with variable light output within a dimming range between a low light output level and a high light output level, wherein the lamp power and the lamp current are monitored, wherein at high light output level the lamp control is based on current control while at low light output level the lamp control is based on power control;

wherein at intermediary levels the lamp control is based on both current control and power control.

2. Method according to claim 1, wherein a first measuring signal (Ilamp) indicating the lamp current is obtained, wherein a second measuring signal (Plamp) indicating the lamp power is obtained, wherein an error signal (Serr) is calculated as a function of the said two measuring signals and as a function of dim level, wherein the control method adapts drive signals for the lamp (L) such as to attempt to make the error signal (Serr) equal to zero, and wherein, with increasing dim level, the contribution of the first measuring signal (Ilamp) to the error signal increases while the contribution of the second measuring signal (Plamp) to the error signal decreases.

3. Method according to claim 2, wherein a current error signal (Ierr) is calculated as being proportional to the difference between the first measuring signal (Ilamp) and a current reference signal (Iref), wherein a power error signal (Perr) is calculated as being proportional to the difference between the second measuring signal (Plamp) and a power reference signal (Pref), and wherein the combined error signal (Serr) is calculated according to the formula $$\text{Serr}=f1(\text{Ierr},\beta)+f2(\text{Perr},\beta)$$

wherein Serr indicates the combined error signal, wherein Ierr indicates the current error signal, wherein Perr indicates the power error signal, wherein β is a parameter proportional to the light output level;

wherein f1 is a function of which the partial derivative δf1/δβ≥0 for all values of β within the dimming range;

and wherein f2 is a function of which the partial derivative δf2/δβ≥0 for all values of β within the dimming range.

4. Method according to claim 3, wherein $$f1(\text{Ierr},\beta)=\beta\cdot\text{Ierr and } f2(\text{Perr},\beta)=(1-\beta)\cdot\text{Perr}.$$

5. Method according to claim 3, wherein the light output level is set by a DALI signal (D) that can take integer values between 1 and 254, and wherein the parameter β is calculated according to the formula $$\beta = 0.01\times 10^{\frac{3(D-1)}{253}-1},$$

wherein D indicates the DALI signal.

6. Lamp driver (100) for driving a fluorescent lamp (L), comprising:

a supply stage (110) for providing a supply power;

a drive stage (120) for receiving the supply power and generating lamp current;

measuring means for generating measuring signals (Sp; Sv) from which the lamp power and the lamp current can be derived;

a control device (130) for controlling the drive stage (120), the control device having inputs (133; 135) for receiving said measuring signals and deriving the lamp power and the lamp current therefrom, the control device further having a user input (131) for receiving a signal indicating the requested light output level dimming level;

wherein the control device is adapted to perform the method claim 1.

* * * * *